US005661985A

United States Patent [19]

Heng

[11] Patent Number: 5,661,985

[45] Date of Patent: Sep. 2, 1997

[54] LOW SMOKE SCREEN HANDLER FOR SMOKE GENERATORS

[76] Inventor: Ping-Fa Heng, 8, Lane 231, Sec. 1, Nan-Kang Road, Lu-Chu, Taoyuan Hsien, Taiwan

[21] Appl. No.: 566,009

[22] Filed: Dec. 1, 1995

[51] Int. Cl.[6] ..... F25D 19/00

[52] U.S. Cl. ..... 62/448; 62/259.1; 62/237; 252/305

[58] Field of Search ..... 62/78, 259.1, 448, 62/237, 404, 407, 426; 252/305, 314

[56] References Cited

U.S. PATENT DOCUMENTS

| | | | |
|---|---|---|---|
| 2,737,780 | 3/1956 | Curell, Jr. | 62/448 |
| 3,859,816 | 1/1975 | McDonald et al. | 62/237 X |
| 4,888,958 | 12/1989 | Ella | 62/237 |
| 5,331,822 | 7/1994 | Belliveau et al. | 252/305 X |

*Primary Examiner*—Harry B. Tanner

*Attorney, Agent, or Firm*—Bucknam and Archer

[57] ABSTRACT

The present invention provides a low smoke screen handler for smoke generators comprising a housing provided therein with a compressor, condensing coils, evaporating coils, and capillaries. After being compressed by the compressor, the high temperature gas refrigerant undergoes heat exchange in the condensing coils to dissipate heat from the refrigerant, heat being absorbed in the evaporating coils to gasify the refrigerant, and an evaporating chamber being formed in the area of the evaporating coils so as to cool other objects, characterized in that the evaporating coils are further covered with a housing and a warm keeping material to form a tunnel type evaporating chamber, one side thereof having a relatively small round opening for connecting to a smoke generator and the other side having a wider opening such that the smoke generated by the smoke generator is introduced through the round opening on the one side is cooled down rapidly to a low temperature smoke screen by multistage cooling in the evaporating chamber, and then discharged from the opening on the other side, thus providing an improved smoke screen handler for the smoke generator.

2 Claims, 7 Drawing Sheets

LOW SMOKE SCREEN HANDLER FOR SMOKE GENERATORS

The present invention relates a low smoke screen handler for smoke generators and, in particular, to such a low smoke screen handler for stage use, which takes advantage of the principle that hot air will rise up while cold air will go down such that warmer smoke is rapidly cooled down to form a layer of low smoke screen close to the surface of the stage.

On the stages, in amusement playhouses, or dancing halls, there is often seen a low smoke screen close to the surface of the stage or on the ground. The effect of such low smoke screen is generally created by using dry ice. Dry ice is carbon dioxide in solid form which will be gasified directly into a white gas having high specific weight at temperature above −78.5° C., the white gas being delivered by electric fans and sinking to the surface of the stage so as to create a floating and intangible effect of unearthly sense on the stage. However, the amount of the low smoke screen formed by the dry ice is unexpectable, and the direction in which the smoke screen moves can not be effectively controlled. In addition, the carbon dioxide gas, if an overdose is inhaled, may adversely affect the health of the human body. It is therefore desired to provide a replacement to reduce the amount of the dry ice in use.

There are currently available a variety of smoke generators in the market which are used to replace dry ice to generate smoke. In such smoke generators, an electric heater is used to heat a smoke oil which is gasified into smoke and then ejected such that the smoke ejected is relative high in temperature, tending to cause discomfort to the skin. Moreover, the smoke has relative low specific weight and thus tends to float up. It is a disadvantage with conventional smoke generators because the low smoke screen can not be generated closely to the surface of the stage to satisfy the users having such requirements.

In view of the above, the present invention provides a low smoke screen handler for smoke generators so as to overcome the disadvantage with conventional smoke generators.

Accordingly, the primary object of the present invention is to provide a low smoke screen handler for smoke generators comprising a compressor, condensing coils, evaporating coils, capillaries, and expansion valves, all of them being installed in a housing, wherein the evaporating coils are separated into five sets of evaporators arranged in a smaller evaporating chamber, both sides of the tunnel type evaporating chamber being each provided with an opening for connecting, respectively, to the smoke generator and to a smoke outlet hose. In this way, the smoke brought into the evaporating chamber can be cooled down rapidly due to the cooling effect produced in the evaporating coils such that a low smoke screen having relative high specific weight can be formed and discharged from the hose.

The the structure, features, and and other objects will become apparent from the detailed description of a preferred embodiment of the present invention in conjunction with the accompanying drawings in which.

Figure 1:
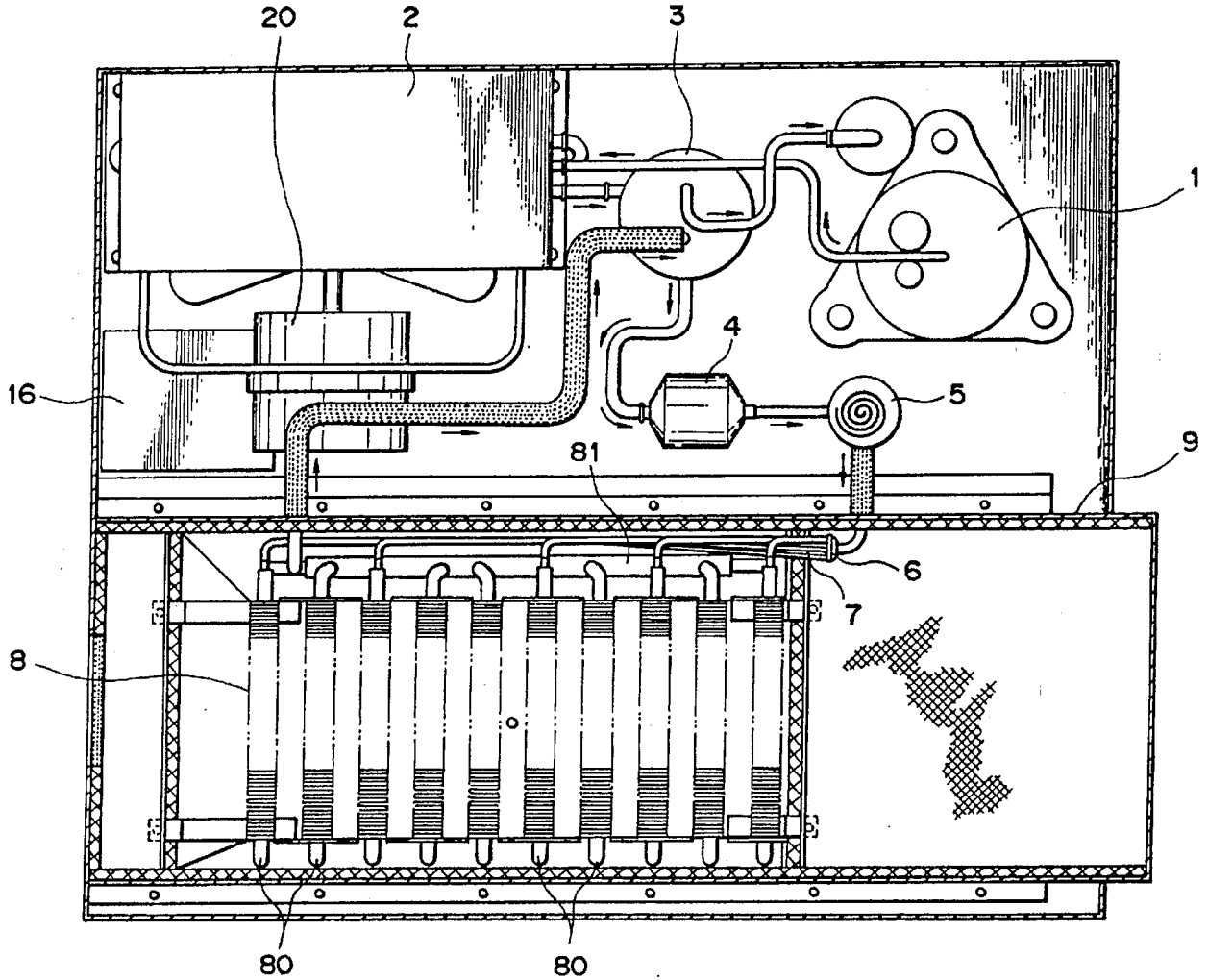
FIG. 1 is a view showing the layout of the various components of the present invention.
Figure 2:
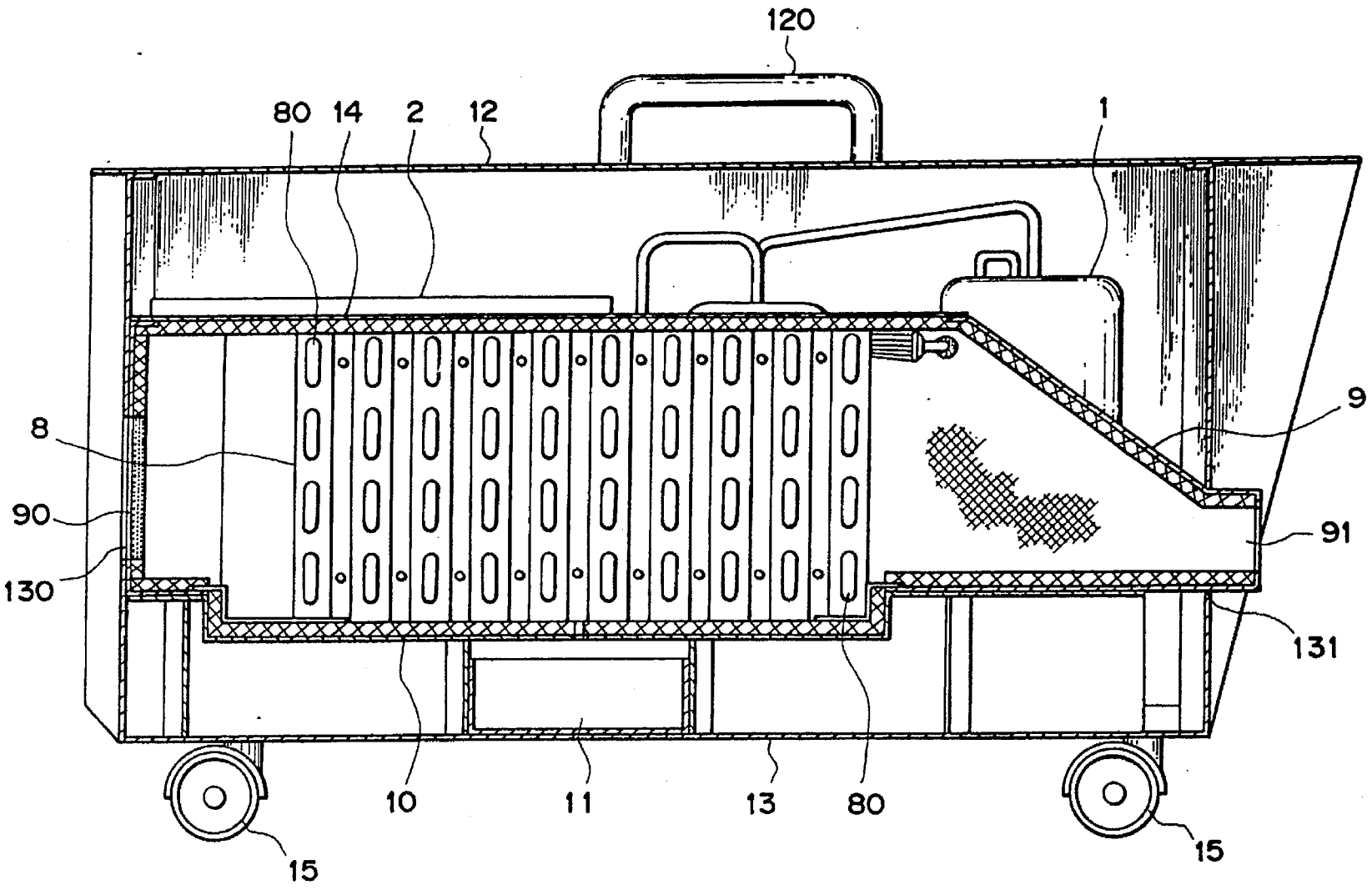
FIG. 2 is a cross section view of the present invention.
Figure 3:
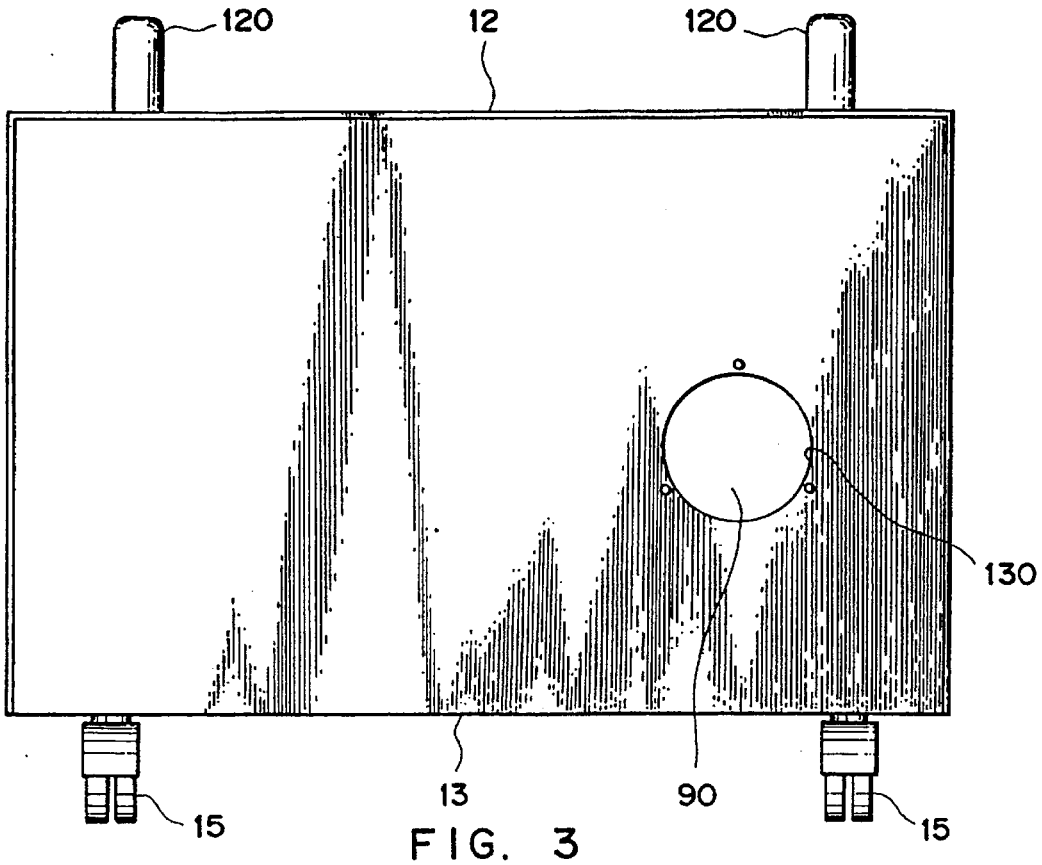
FIG. 3 is a left side view of the present invention.
Figure 4:
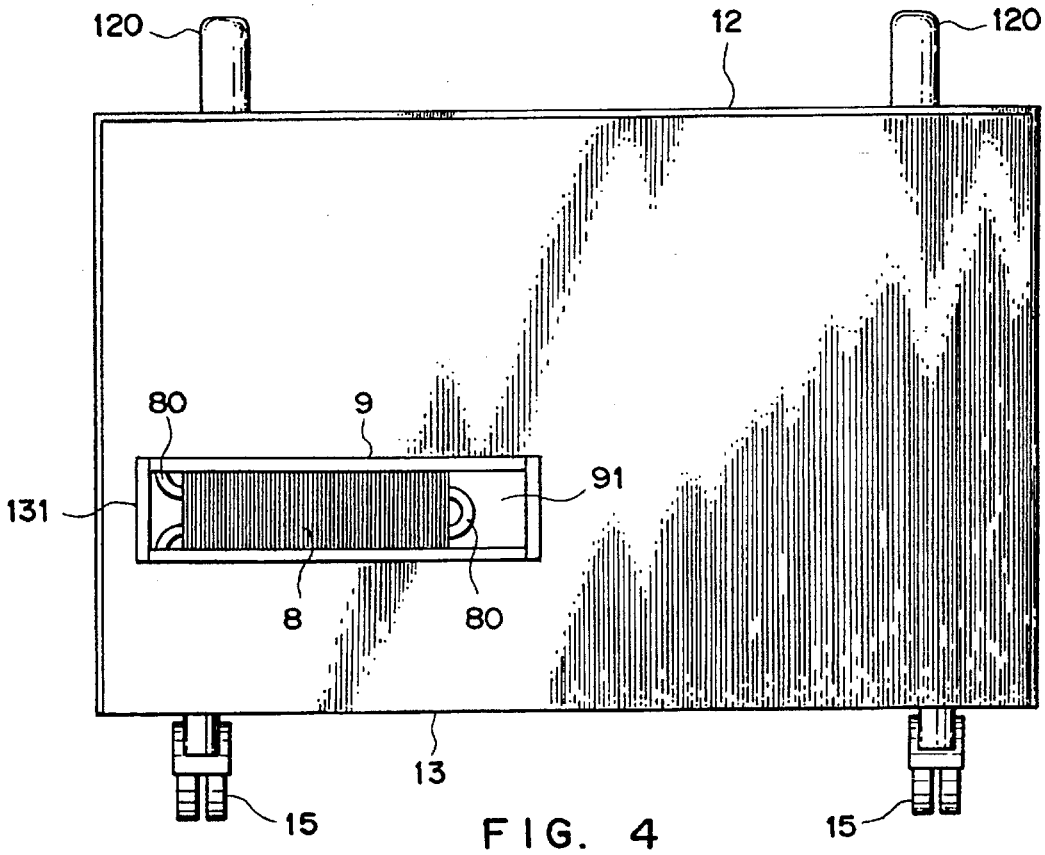
FIG. 4 is a right side view of the present invention.
Figure 5:
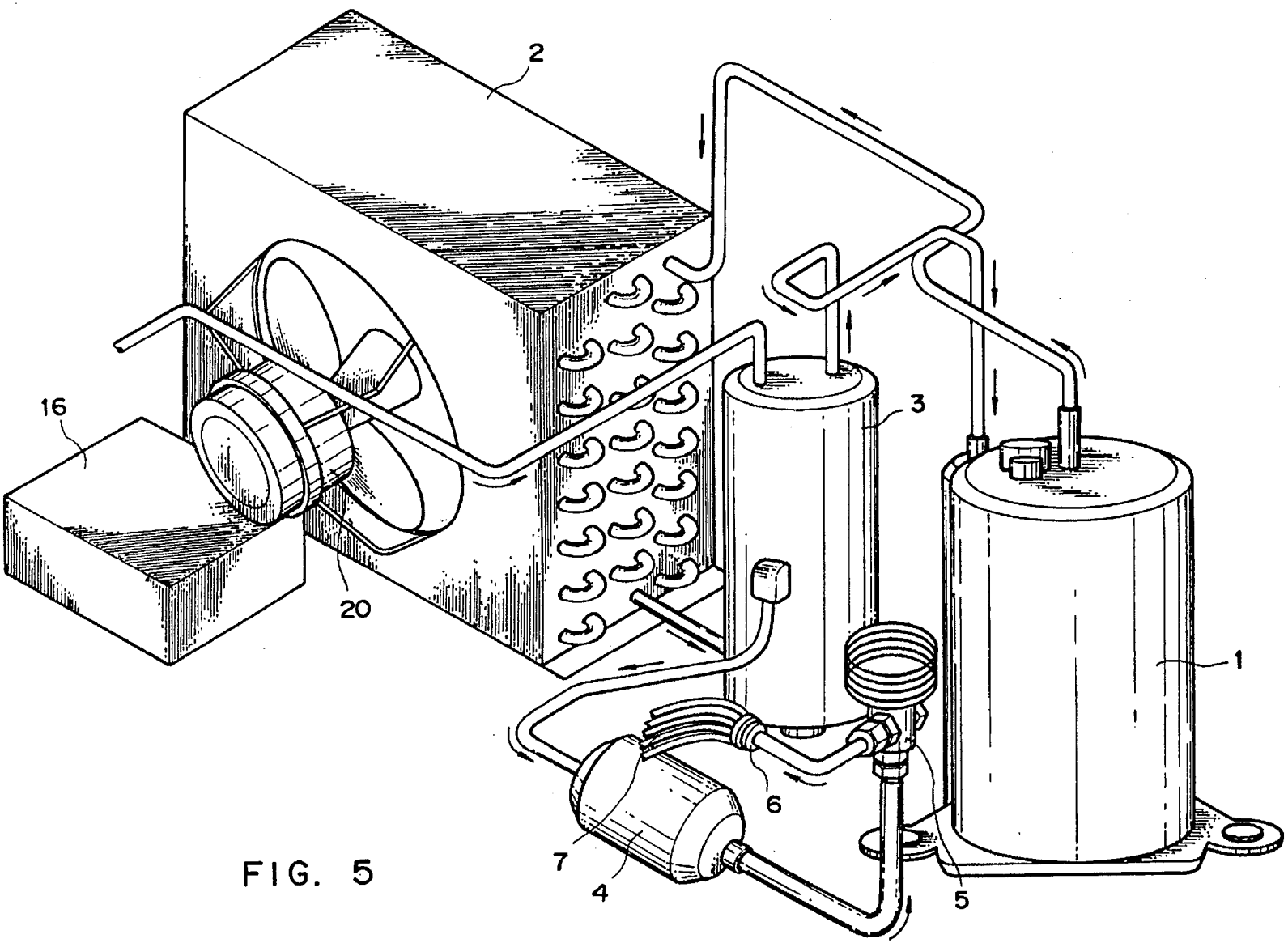
FIG. 5 is a view showing the tubing connecting the compressor of the present invention.
Figure 6:
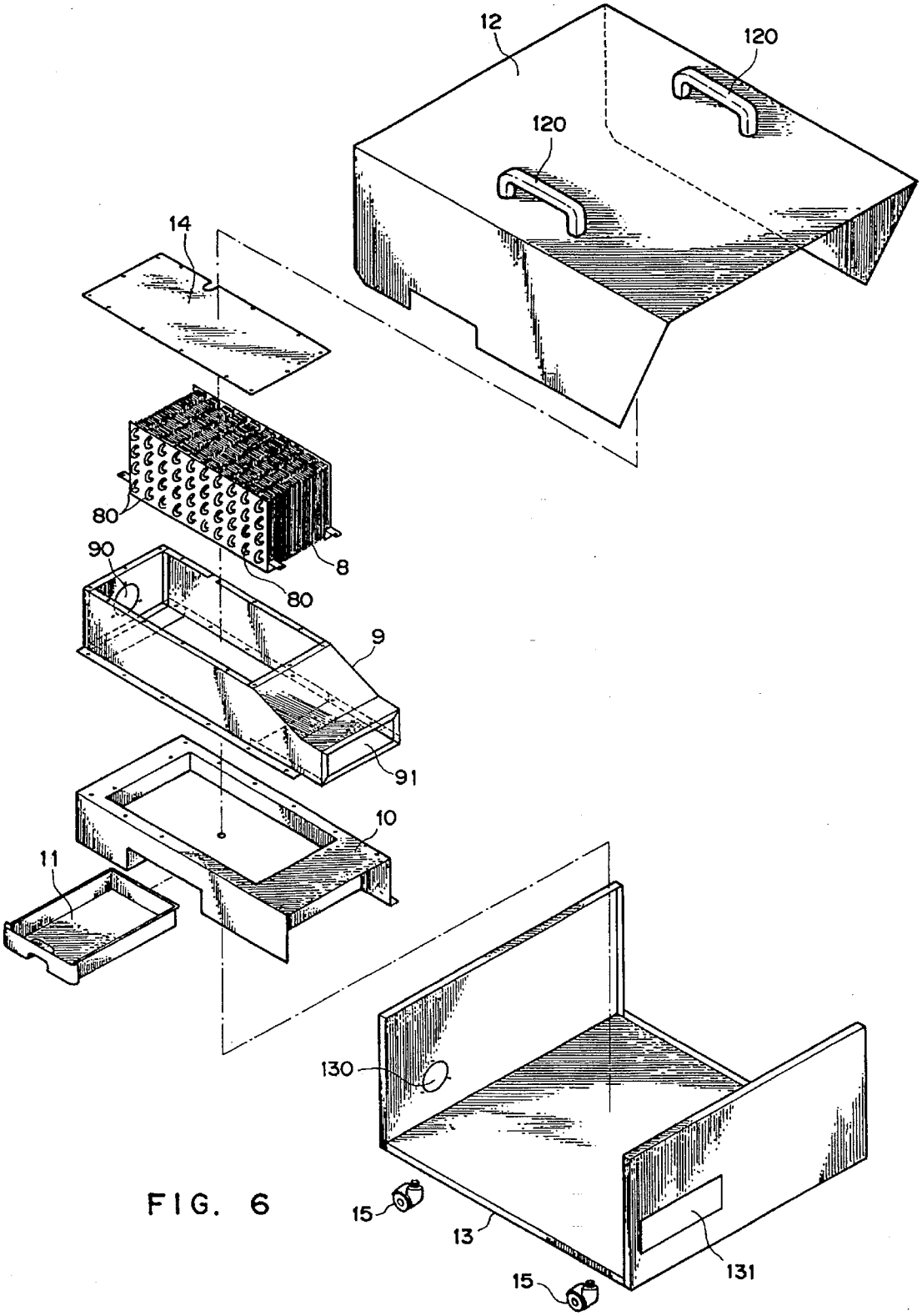
FIG. 6 is a partly exploded perspective view of the present invention.

First referring to FIGS. 1 and 5, there is shown the smoke screen handler for smoke generators comprising:

- a compressor 1 for compressing the low pressure and normal temperature gas refrigerant flowing out from the evaporating coils 8 into a high pressure and high temperature gas refrigerant and has it delivered to the condensing coils 2;
- condensing coils 2 which, in conjunction with a fan 20, can carry out heat exchange between the high pressure and high temperature gas refrigerant and the air for dissipating heat so as to form the high pressure and normal temperature gas refrigerant;
- a mixing cylinder 3 in which heat exchange between the high pressure and normal temperature gas refrigerant delivered from the condensing coils 2 and the low pressure and low temperature gas refrigerant flowing out from the evaporating coils 8 are carried out such that the remaining liquid refrigerant from the evaporating coils 8 is gasified and the temperature of the gas refrigerant from the condensing coils is lowered;
- a dryer 4 for absorbing the water remaining in the tubing of the refrigerant so as to enhance the cooling effect and to prevent the tube from corroding and the clogging of the expansion valve 5;
- an expansion valve 5 for effecting constriction and expansion so as to have the liquid refrigerant separated from the gas and to regulate the amount of the refrigerant flowing into the evaporating coils 8 such that the evaporating coils 8 perform the maximum effect of heat exchange;
- a distributor 6 for distributing the high pressure and low temperature liquid refrigerant delivered from the expansion valve 5 into five groups connecting to capillaries 7;
- five groups of capillaries 7 connecting to five sets of evaporators 80 for reducing the high pressure and low temperature liquid refrigerant to the low pressure and low temperature liquid refrigerant;
- evaporating coils 8 being separated into five sets of evaporators 80 installed in the evaporating chamber 9, the inlet of each set of the evaporator 80 being connected to a capillary 7 and the outlet being connected to a converging tube 81 for carrying out heat exchange such that the low pressure and low temperature liquid refrigerant is converted to the low pressure and normal temperature gas refrigerant and bringing about the cooling effect, the low pressure and normal temperature gas refrigerant being collected and then transferred back to the compressor 1.

Referring to FIGS. 2, 3, 4, and 6, the above components are installed in a housing consisting of an upper cap 12 and a base 13, the upper cap being provided with a handle 120 with which the upper cap 12 can be removed conveniently for maintenance. The base 13 is provided with pulley 15 for the convenience of carrying the unit, one side of the base 13 being provided with a removable water collecting tray 10. Under said water collecting tray 10; an insertable water collecting box 11 is installed. The upper portion of a water collecting tray 10 is placed into the evaporating chamber 9, the tunnel type evaporating chamber 9 being roughly rectangular in shape such that whole set of the evaporating coils 8 can be placed therein to form a refrigerating area, the evaporating chamber 9 being provided on the left side with a relative small round opening 90 and on the right side with a rectangular opening 91 such that when the evaporating chamber 9 is placed on top of water collecting tray 10, the openings 90, 91 are aligned respectively with the left and right openings 130, 131 of the base 13.

In addition, after the evaporating coils 8 are placed into the evaporating chamber 9, the latter is covered with a cover plate 14 and a warm keeping material so as to increase the refrigerating effect. When the compressor 1 is started, the low pressure and low temperature gas refrigerant from the evaporating chamber 9 is introduced into an intake orifice and compressed into the high pressure and high temperature gas refrigerant, then being discharged into the evaporating coils 2 for heat exchange such that heat is dissipated from the high pressure and high temperature gas refrigerant which becomes a high pressure and normal temperature liquid refrigerant. Thereafter, through the constriction by the expansion valve 5 and pressure reduction by the capillaries 6, the low pressure and low temperature liquid refrigerant is distributed to each set of the evaporators 80 by the distributor 6. Each evaporator 80 in the evaporating chamber 9 starts to absorb large amount of heat, causing the liquid refrigerant to become gasified, thus bringing about the refrigerating effect. By forming the evaporating chamber 9 into a multi-stage tunnel type refrigerating chamber, the refrigerating effect can cool the smoke to be introduced down rapidly to form the low smoke screen on one hand and the water in the air is cooled to become condensed in the water collecting tray 10 and collected into the water collecting box 11 for removal on the other hand.

Figure 7:
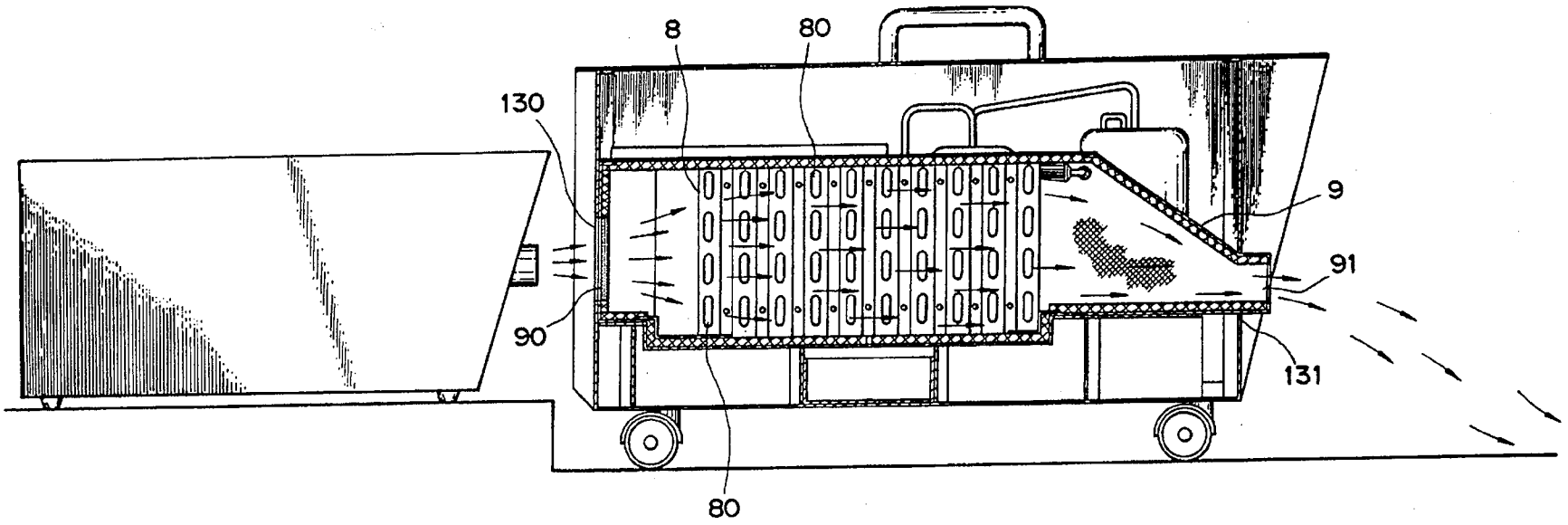
FIG. 7 is a view showing a preferred embodiment of the present invention.

Referring to FIG. 7, there is shown an preferred embodiment of the present invention. During actual operation, after the handler is moved to position, it starts to operate when power supply is connected such that refrigerating effect occurs in the evaporating chamber 9, the opening 90 on the left side of the evaporating chamber 9 being connected to a smoke generator such that when the smoke generator is heated, the smoke oil is gasified and discharged, the warmer smoke floating up and being introduced from the opening 90 and all the way to the last set of evaporators 80. The temperature of the smoke passing through the evaporating 80 is lowered rapidly due to the rapid refrigerating effect, thus the smoke becoming a low smoke screen having a greater specific weight than the air and being delivered out from the other opening 91 of the evaporating chamber, and then distributed over the stage or the ground.

Figure 8:
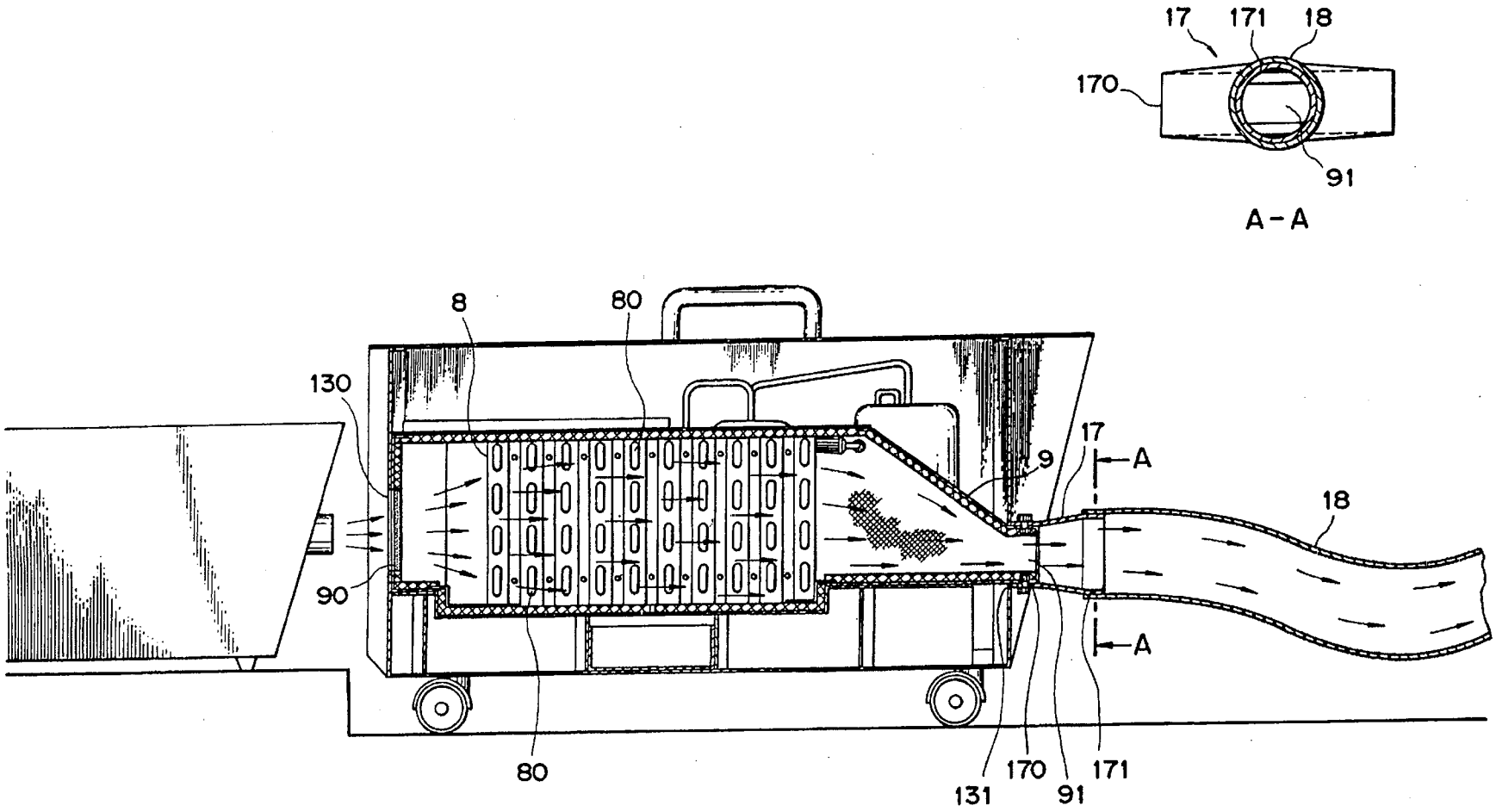
FIG. 8 is a view showing another preferred embodiment of the present invention.

Referring to FIG. 8, there is shown another preferred embodiment of the present invention. A switch head 17 may be connected to the outlet of said evaporator 80 used to form the low smoke screen, the switching head 17 being flared in shape with one end having a rectangular opening 170 fitted over the right side opening of the evaporating chamber 9 and the other end having a round opening 171 connected to a hose 18 such that the place and the direction in which the low smoke screen is ejected can be controlled, thus overcoming the disadvantage with the conventional method of make smoke screen from dry ice.

The present invention, while simple in structure, provides an innovative technique for handling the low smoke screen which widens the field of application in which the smoke generator can be used. In particular, a special evaporating chamber is employed enabling each evaporator in the evaporating chamber to perform rapid heat exchange for cooling other objects. Moreover, with every evaporator 80 having the same refrigerating capability, the smoke passing through will get colder and colder while specific weight becomes greater and greater, thus forming a smoke screen closer to the ground. As a result, a better overall stage effect can be achieved and such effect is unable to obtain with the conventional smoke generators.

While the features and advantages of the present invention have been described by way of a preferred embodiment, it is intended that the description by no means limits the scope of the present invention. Various changes and modifications can be made to the above preferred embodiment by those skilled in the art and such changes and modification should be considered as being within the scope of the appended claims.

LIST OF REFERENCE NUMBERS

1 compressor 15 pulley
2 condensing coils 16 distribution box
3 mixing cylinder 17 switching head
4 dryer 18 hose
5 expansion valve 20 fan
6 distributor 80 evaporator
7 capillaries 81 converging tube
8 evaporating coils 90 opening
9 evaporating chamber 91 opening
10 water collecting tray 120 handle
11 water collecting box 130 opening
12 upper cap 131 opening
13 base 170 opening
cover plate 171 opening

I claim:

1. A low smoke screen handler for smoke generators comprising a housing provided therein with a compressor, condensing coils, a mixing cylinder, a dryer, an expansion valve, capillaries, and evaporating coils wherein a refrigerant is used to absorb heat to cool the smoke in an evaporating chamber, the evaporating coils being separated into five sets of evaporators each being connected to a capillary, the outlets for the gas refrigerant being all connected to a converging tube for returning to the compressor, the evaporating coils being placed into the evaporating chamber, the evaporating chamber being roughly rectangular in shape with the left side having a relative small round opening and the right side having a rectangular opening, after receiving the evaporating coils, the evaporating chamber being covered with a cover plate and then secured over a water collecting tray; characterized in that the round opening on the left side of the evaporating chamber is connected to a smoke generator such that after the smoke is introduced into the evaporating chamber, it is cooled down rapidly to become a low smoke screen of relative high specific weight and ejected from the opening on the right of the evaporating chamber.

2. A low smoke screen handler for smoke generators according to claim 1, wherein the evaporating chamber is further provided with a switching head, said switching head being flared in shape with one end having a rectangular opening for connecting to the opening on the right side of the evaporating chamber and the other side having a round opening for connecting to a hose so as to adjust the direction in which the low Smoke screen is flowing.

* * * * *